US006817124B1

(12) United States Patent
Ko

(10) Patent No.: US 6,817,124 B1
(45) Date of Patent: Nov. 16, 2004

(54) ARTISTIC BLACK/WHITE BOARD

(76) Inventor: Jung-Kuei Ko, No. 103, Chi Hsien 1 Road, Kaohsiung (TW)

( * ) Notice: Subject to any disclaimer, the term of this patent is extended or adjusted under 35 U.S.C. 154(b) by 52 days.

(21) Appl. No.: 10/430,241

(22) Filed: May 5, 2003

(51) Int. Cl.[7] ..... B43L 1/00

(52) U.S. Cl. ..... 40/471; 40/518; 428/195.1; 434/426

(58) Field of Search ..... 428/98, 906, 195.1; 434/426, 411, 412; 40/471, 518

(56) References Cited

U.S. PATENT DOCUMENTS 4,761,139 A * 8/1988 Mashiach ..... 434/410

* cited by examiner

*Primary Examiner*—Alexander S. Thomas
(74) *Attorney, Agent, or Firm*—Pro-Techtor International Services

(57) ABSTRACT

An artistic black/white board with decorative function. The artistic black/white board has an artistic frame. Two reels are hidden in two opposite sides of the frame. At least one picture is extensibly wound on one of the reels. In use, the artistic black/white board serves as a normal black/white board for writing and memorizing things. When not used, the picture is pulled out and unwound from the reel to cover the black/white board to serve as a wall painting for achieving a decorative effect and beautifying the appearance.

6 Claims, 4 Drawing Sheets

ARTISTIC BLACK/WHITE BOARD

BACKGROUND OF THE INVENTION

The present invention is related to an artistic black/white board with decorative function. Two reels are hidden in two opposite sides of the frame of the black/white board. At least one picture is extensibly wound on one of the reels. When not used, the picture is pulled out and unwound from the reel to cover the black/white board to achieve a decorative effect.

All kinds of large-size and small-size black/white boards are widely used in different institutes, offices and families for writing and memorizing things. A conventional black board is fixed on a wall. Other movable black/white boards are hung on a bracket fixed on a wall.

The conventional black/white board has a frame and a black/white panel enclosed in the frame. A fixed or movable pen channel is disposed on the frame for placing pens therein. Such black/white board is simply for writing and memorizing things and has no other function. When not used, such black/white board is stored in a storage to occupy much room or hollowly hung on the wall to lead to a poor appearance.

SUMMARY OF THE INVENTION

It is therefore a primary object of the present invention to provide an artistic black/white board with decorative function. The artistic black/white board has an artistic frame. Two reels are hidden in two opposite sides of the frame. At least one picture is extensibly wound on one of the reels. In use, the artistic black/white board serves as a normal black/white board for writing and memorizing things. When not used, the picture is pulled out and unwound from the reel to cover the black/white board to serve as a wall painting for achieving a decorative effect and beautifying the appearance.

The present invention can be best understood through the following description and accompanying drawings wherein:

DETAILED DESCRIPTION OF THE PREFERRED EMBODIMENTS

Figure 1:
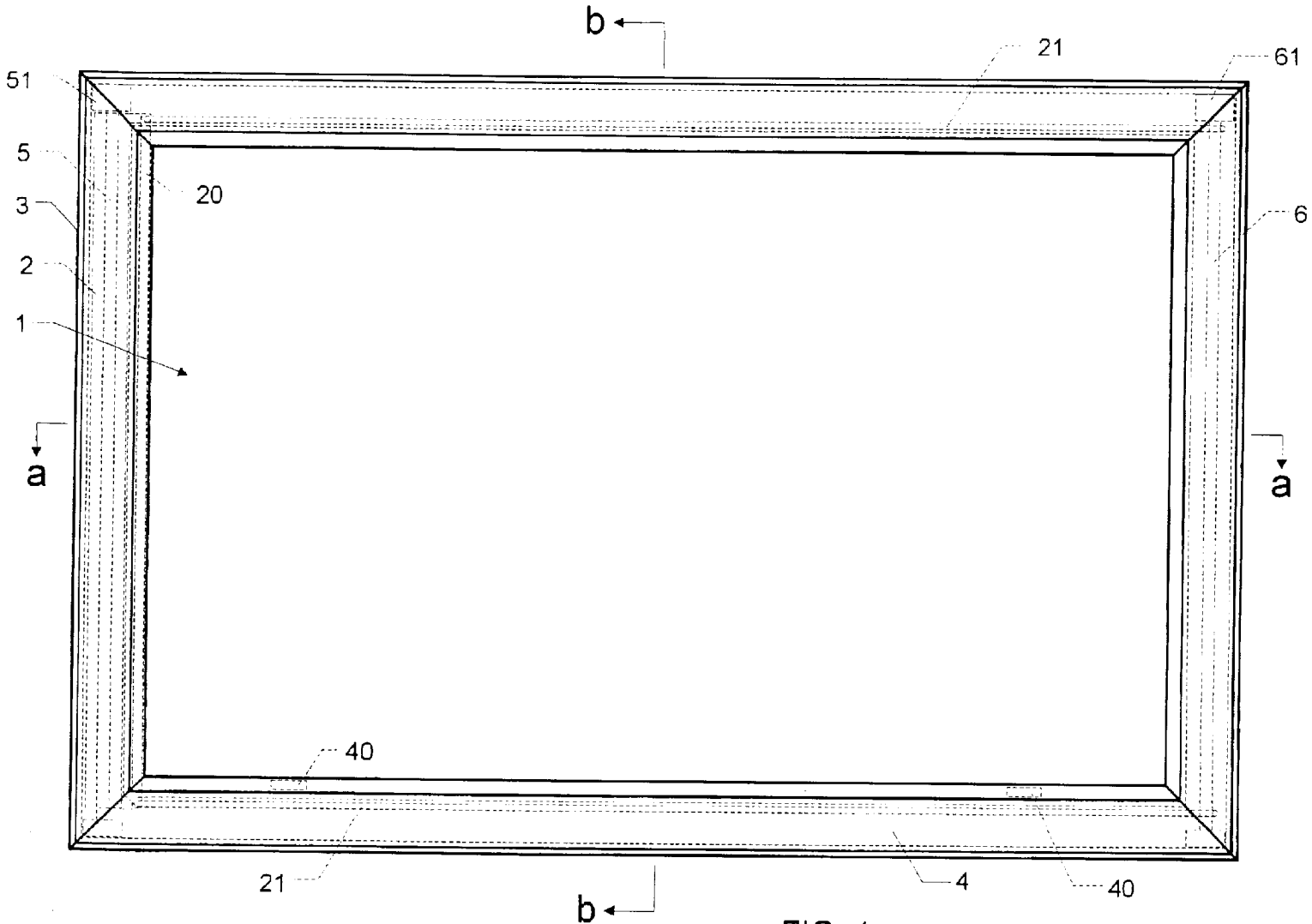
FIG. 1 is a front view of the present invention.
Figure 2:
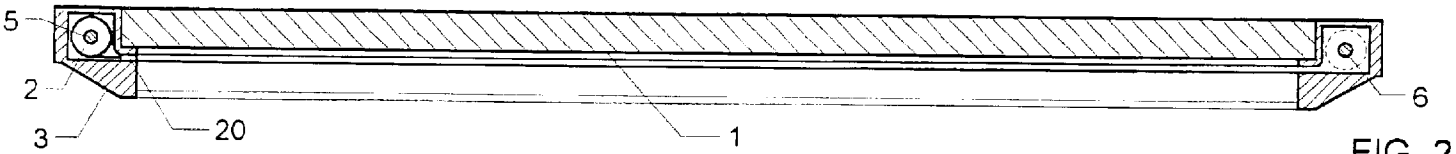
FIG. 2 is a sectional view taken along line a—a of FIG. 1.
Figure 4:
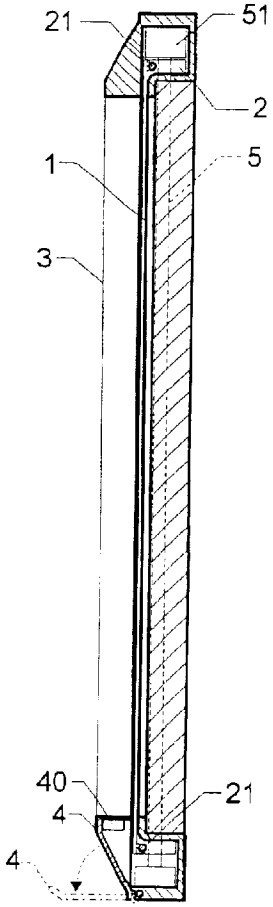
FIG. 4 is a sectional view according to FIG. 3, showing that the pen channel is swung down for placing pens therein.
Figure 3:
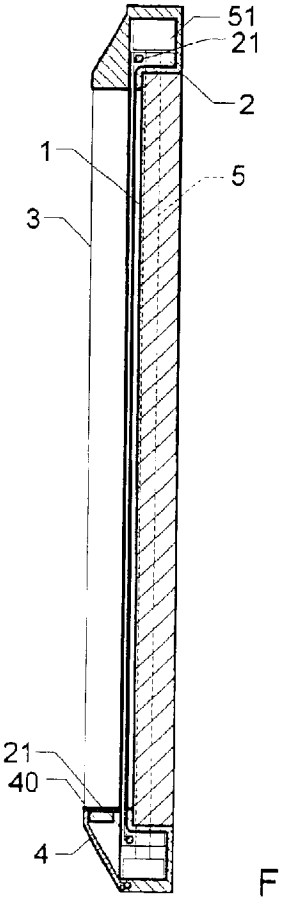
FIG. 3 is a sectional view taken along line b—b of FIG. 1.

Please refer to FIGS. 1 to 4. The artistic black/white board of the present invention includes a black/white panel 1, a picture 2, a frame 3, a pen channel 4, a first reel 5 and a second reel 6.

The panel 1 is enclosed in the frame 3. The frame 3 is formed with decorative face such as artistic face. The frame

3 is made of metallic material (such as aluminum alloy) or nonmetallic material (such as wooden or plastic material). The reels 5, 6 are hidden in two opposite sides of the frame 3. The picture 2 is extensibly wound on the first reel 5. Gaps are formed between the inner edges of the opposite sides of the frame 3 and the panel 1 for the picture 2 to pass therethrough. A guide board 20 is disposed on the front edge of the picture 2. The upper and lower ends of the guide board 20 are connected with pull cords 21 conducted to the other reel 6. The pull cords 21 are for pulling out the picture 2. When not used, the pull cords 21 are not exposed to outer side. The reels 5, 6 are equipped with winding members 51, 61 which can be stageless transmission motors (with damping function for avoiding free idling so that when pulling out the picture or winding back the picture, the picture is tensioned without loosening). Alternatively, the winding members 51, 61 can be manual rotary switches or cranks. An automatic detection element (such as electric eye ranger or electronic shade monitor) can be arranged in a certain position to automatically control the pulling distance of the picture 2 so as to accurately locate the picture 2. The electronic detection elements pertain to prior art and are optionally installed. Alternatively, the electronic detection element can be omitted and the pulling distance of the picture can be visually controlled. The width of the picture is larger than the distance between the opposite sides of the frame so that the lateral sides of the panel are not exposed to outer side. More than one different picture can be wound on the reel 5 to achieve different decorative effect.

An up and down swingable pen channel 4 is disposed on the lower side of the frame 3. When not used, the pen channel 4 is upward swung and located on the frame 3 as a part thereof. The pen channel 4 can be fixed by a magnet 40 or any other engaging measure. In use, the pen channel 4 is swung down to a horizontal position for placing pens thereon.

Figure 6:
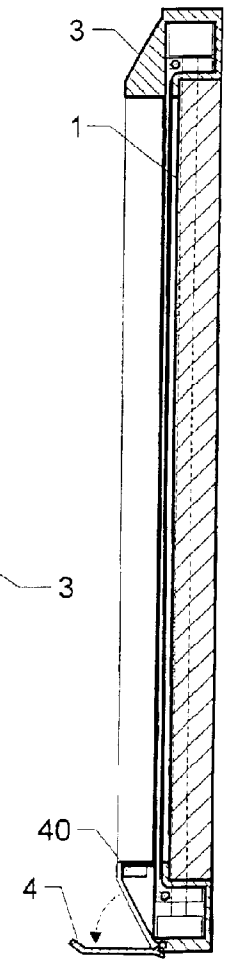
FIG. 6 is a sectional view taken along line c—c of FIG. 5.
Figure 5:
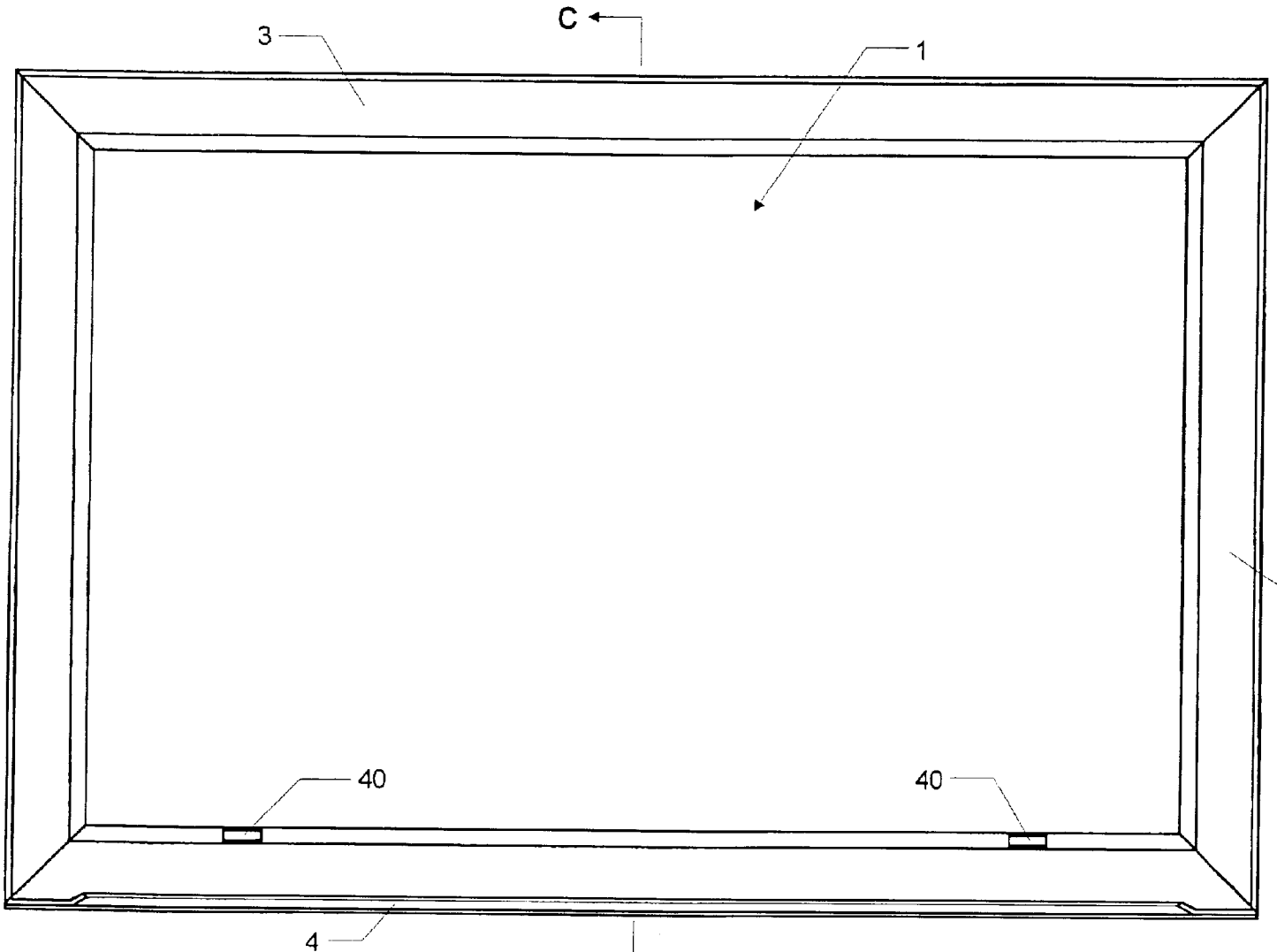
FIG. 5 is a front view of the present invention.
Figure 8:
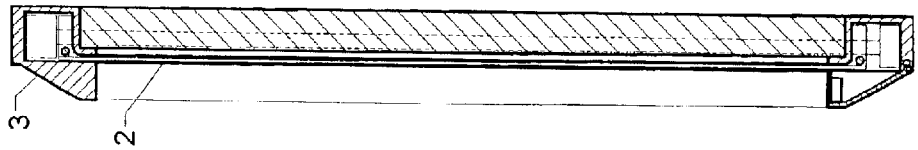
FIG. 8 is a sectional view taken along line d—d of FIG. 7.
Figure 7:
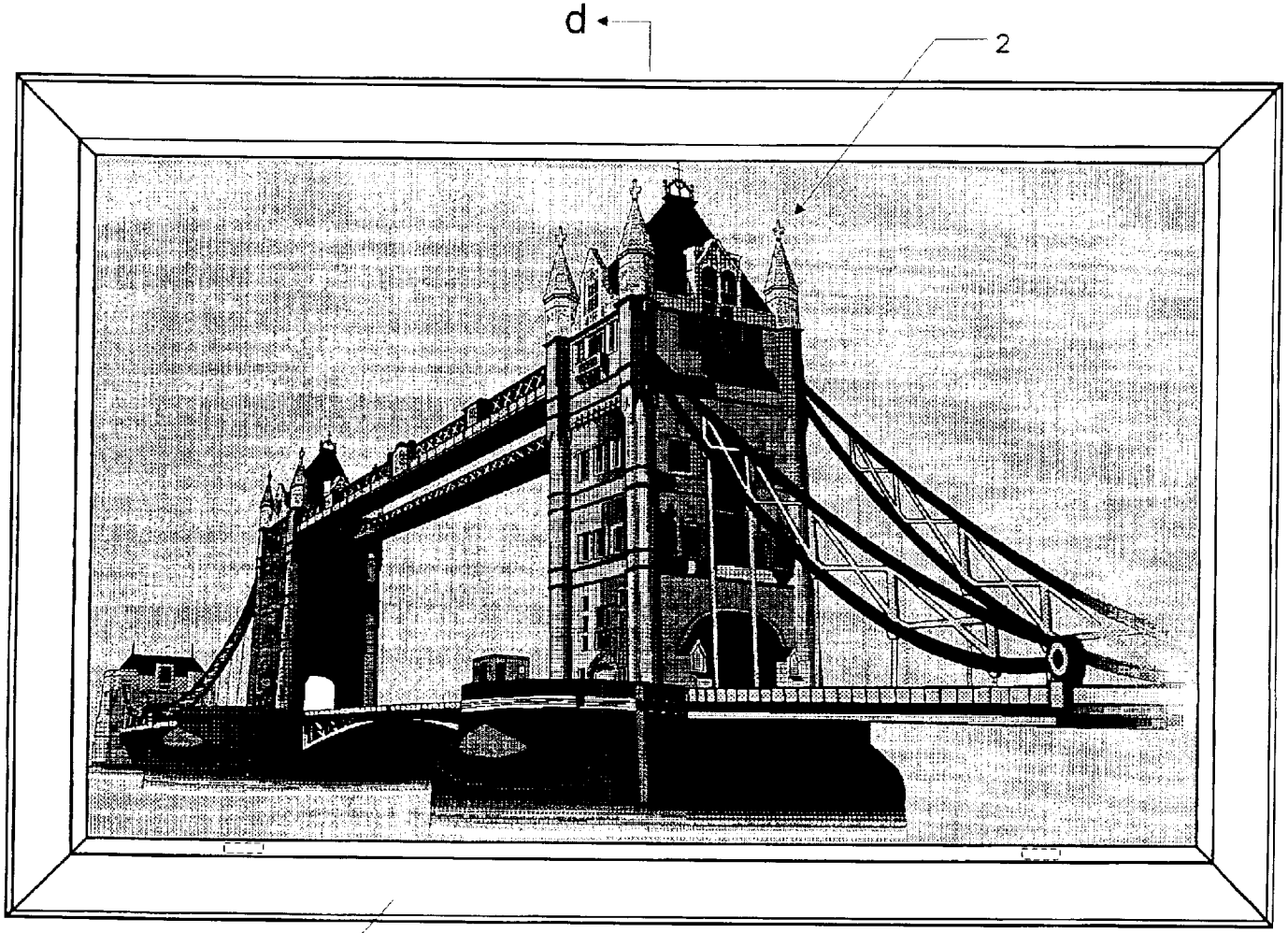
FIG. 7 shows that the picture is pulled out to cover the black/white board of the present invention to serve as a wall painting.

Referring to FIGS. 5 to 8, in use, the artistic black/white board of the present invention serves as a black/white board for writing and memorizing things. When not used, the decorative picture can be pulled out to serve as a wall painting for achieving a decorative effect and beautifying the appearance.

The above embodiments are only used to illustrate the present invention, not intended to limit the scope thereof. Many modifications of the above embodiments can be made without departing from the spirit of the present invention.

What is claimed is:

1. An artistic black/white board comprising a black/white panel, at least one picture, a frame and two reels, the panel being enclosed in the frame, the reels being hidden in two opposite sides of the frame, the picture being extensibly wound on one of the reels, front edge of the picture being connected with pull cords conducted to the other reel, whereby the picture can be pulled out to cover the panel of the black/white board.

2. The artistic black/white board as claimed in claim 1, wherein the frame is made of metallic or nonmetallic material and formed with artistic face, gaps being formed between inner edges of the opposite sides of the frame and the panel for the picture to pass therethrough.

3. The artistic black/white board as claimed in claim 1, wherein more than one picture is extensibly wound on the reel.

4. The artistic black/white board as claimed in claim 1, wherein the reels are equipped with winding members which can be stageless transmission motors or manual rotary switches or cranks.

5. The artistic black/white board as claimed in claim 1, wherein an up and down swingable pen channel is disposed on a lower side of the frame.

6. The artistic black/white board as claimed in claim 1, wherein a guide board is disposed on front edge of the picture, upper and lower ends of the guide board being connected with pull cords which are conducted to the other reel.

* * * * *